US009433999B2

(12) United States Patent
Park et al.

(10) Patent No.: US 9,433,999 B2
(45) Date of Patent: Sep. 6, 2016

(54) MANUFACTURING METHOD OF CORE AND CASTING PRODUCT USING INORGANIC BINDER

(71) Applicant: DR AXION CO., LTD., Busan (KR)

(72) Inventors: Jeong Wook Park, Ulsan (KR); Woo Chun Kim, Busan (KR); Ki Myoung Kwon, Busan (KR); Man Sig Lee, Yangsan-si (KR); Myung Hwan Kim, Yangsan-si (KR); Min A Bae, Daegu (KR)

(73) Assignee: DR AXION CO., LTD., Busan (KR)

( * ) Notice: Subject to any disclaimer, the term of this patent is extended or adjusted under 35 U.S.C. 154(b) by 0 days.

(21) Appl. No.: 14/954,135

(22) Filed: Nov. 30, 2015

(65) Prior Publication Data

US 2016/0207099 A1 Jul. 21, 2016

(30) Foreign Application Priority Data

Jan. 20, 2015 (KR) ..... 10-2015-0009546

(51) Int. Cl.

| | |
|---|---|
| ***B22C 1/16*** | (2006.01) |
| ***B22C 9/10*** | (2006.01) |
| ***B22C 13/12*** | (2006.01) |
| ***B22C 15/24*** | (2006.01) |
| ***B22D 29/00*** | (2006.01) |
| ***C21D 1/60*** | (2006.01) |

(52) U.S. Cl.

CPC ..... *B22C 9/10* (2013.01); *B22C 13/12* (2013.01); *B22C 15/24* (2013.01); *B22D 29/001* (2013.01); *C21D 1/60* (2013.01)

(58) Field of Classification Search

CPC ..... B22C 1/16; B22C 1/167; B22C 9/10; B22C 13/12; B22C 15/24; B22D 29/00

USPC ..... 164/528, 369, 228; 106/38.3, 38.35

See application file for complete search history.

(56) References Cited

U.S. PATENT DOCUMENTS

| | | | | |
|---|---|---|---|---|
| 4,135,569 | A * | 1/1979 | Drobnik et al. | B22C 15/24 164/158 |
| 4,357,984 | A * | 11/1982 | Buhrer | B22C 5/12 164/193 |
| 6,467,525 | B2 * | 10/2002 | Herreid et al. | B22C 9/12 106/38.4 |
| 2011/0100255 | A1 | 5/2011 | Kim et al. | |

FOREIGN PATENT DOCUMENTS

| | | | |
|---|---|---|---|
| JP | 07155900 | A | 6/1995 |
| KR | 1020090011520 | A | 2/2009 |
| KR | 10-1199111 | B1 | 11/2012 |

OTHER PUBLICATIONS

English Abstract, Publication No. JP H07 155900 A, Patent Abstracts of Japan, 1 page.

English Abstract, Publication No. 1020090011520 A, Korean Patent Abstracts, 1 page.

* cited by examiner

*Primary Examiner* — Kevin P Kerns

(74) *Attorney, Agent, or Firm* — Ware, Fressola, Maguire & Barber LLP

(57) ABSTRACT

The present disclosure relates to a manufacturing method of a core using an inorganic binder, a core manufactured thereby, a manufacturing method of a casting product with a core using an inorganic binder, a casting product manufactured thereby, and a manufacturing system of a core using an inorganic binder.

13 Claims, 7 Drawing Sheets

PRIOR ART

MANUFACTURING METHOD OF CORE AND CASTING PRODUCT USING INORGANIC BINDER

CROSS-REFERENCE TO RELATED APPLICATION

This application claims priority to and the benefit of Korean Patent Application No. 2015-0009546, filed on Jan. 20, 2015, the disclosure of which is incorporated herein by reference in its entirety.

THE NAMES OF THE PARTIES TO A JOINT RESEARCH AGREEMENT

The subject matter disclosed and the claimed invention, in the field of "Development of Inorganic Binder for Manufacturing Sand Molds and Environmentally Friendly Cores," was made by or on behalf of DR AXION CO., LTD and KOREA INSTITUTE OF INDUSTRIAL TECHNOLOGY as a result of activities undertaken within the scope of a joint research agreement, said agreement having been executed on Oct. 1, 2013, and in effect on and before the date the claimed invention was made.

BACKGROUND

1. Field of the Invention

The present disclosure relates to a manufacturing method of a core using an inorganic binder, a core manufactured thereby, a manufacturing method of a casting product with a core using an inorganic binder, a casting product manufactured thereby, and a manufacturing system of a core using an inorganic binder.

2. Description of the Related Art

Korean casting foundry industry has greatly contributed to all kinds of industries including shipbuilding industry, auto-parts industry, industrial machine industry, construction machine industry, and the like. Although the casting foundry industry is an important basic industry indispensable for the development of national industry, the current environment surrounding the casting foundry industry, such as environmental problems, price fluctuations in subsidiary materials, policies, lack of manpower, and the like, is not very good. Above all, the environmental problems have been set as a priority to be solved. Currently, in the casting industry, environmental pollution has been improved in order to block discharge of environmental pollutants generated during a metal dissolution process, a core manufacturing process, and a casting process. However, since the casting industry has been regulated in greenhouse gas emission by the Muskie Act, the Kyoto Protocol, and the like, a method for getting rid of discharge of basic pollutants and a technical method for reduction in energy consumption, improvement in working environment, and greening of manufacturing sites have been urgently needed.

Generally, a core used in the casting industry is produced by mixing sand and an organic binder and curing the mixture with a core making machine and a mold. FIG. 1 is a flowchart illustrating a manufacturing process of a core and a casting product using an organic binder according to the prior art.

However, as illustrated in FIG. 1, if a core is manufactured by using an organic binder, environmental pollution is caused by the organic binder and energy consumption is increased as a curing process using a heater proceeds, resulting in a decrease in life of a mold. Furthermore, if a casting process is performed with the core manufactured by using the organic binder, a core gas is generated during the casting process, resulting in deterioration in quality of a casting product, a decrease in life of the mold, and environment pollution.

Accordingly, there is a need for development of a new binder as a substitute for a conventional organic binder in response to the requests for improvement in quality of a casting product, securing of price competitiveness, and strengthening of environmental regulations. Currently, a study for developing an inorganic binder which is an eco-friendly substance with high quality and low price has been conducted.

However, if a core is manufactured by using an inorganic binder, a curing process can be performed at a low temperature and a toxic substance is not generated, and, thus, a working environment is kept in a good condition. Furthermore, just a small amount of a gas is generated during a manufacturing process of a core and a casting process, and, thus, defects in casting are reduced, and there is no need to install an anti-environmental pollution system, and, thus, manufacturing costs can be reduced. However, the inorganic binder may cause deterioration in quality of the core due to its hygroscopic property and sand burning phenomenon.

Accordingly, the inventors of the present disclosure have tried to satisfy the above-mentioned technical demands, and finally completed the present disclosure by improving a process and developing a manufacturing method of a core and a casting product improved in hygroscopic property and sand burning phenomenon by using an inorganic binder which is improved in property such as water resistance, strength, and castability.

SUMMARY

Accordingly, an object of the present disclosure is to provide a manufacturing method of a core using an inorganic binder.

Furthermore, another object of the present disclosure is to provide a core manufactured by the above-described manufacturing method.

Also, yet another object of the present disclosure is to provide a manufacturing method of a casting product with the core using an inorganic binder.

Furthermore, still another object of the present disclosure is to provide a casting product manufactured by the manufacturing method of a casting product with the core using an inorganic binder.

Furthermore, still another object of the present disclosure is to provide a manufacturing system of a core using an inorganic binder.

According to a first aspect to achieve an object of the present disclosure, there is provided a manufacturing method of a core using an inorganic binder, including:

an original sand supplying step in which original molding sand is supplied to a muller;

a mulling step in which the original molding sand is mixed and mulled with a liquid inorganic binder including water glass and mulled sand is prepared by the muller;

a sand transferring step in which the mulled sand is transferred from the muller to a mulled sand hopper;

a sand supplying step in which the mulled sand is supplied from the mulled sand hopper to a blowing head positioned under the mulled sand hopper;

a blowing step in which the mulled sand supplied into the blowing head is blown into a core mold;

a gas exhausting step in which the inside of the core mold is exhausted and depressurized;

a curing step in which after the core mold is preheated, the inside of the blown core is cured and calcined; and an extracting step in which the core mold is separated and the cured core is extracted, wherein the inorganic binder includes the water glass of 40 to 70 parts by weight, nano-silica of 5 to 35 parts by weight, a Li-based water resistant additive of 0.1 to 10 parts by weight, an organic silicon compound of 0.1 to 10 parts by weight, and an anti-sand burning additive of 1 to 10 parts by weight.

Preferably, the inorganic binder is mixed in an amount of 1 to 6 weight % with respect to the original molding sand.

Furthermore, preferably, the Li-based water resistant additive includes one or more selected from lithium carbonate, lithium silicate, lithium hydroxide, lithium sulfate, lithium bromide, and lithium acetate.

Furthermore, preferably, the organic silicon compound includes one or more selected from methyltriethoxysilane, sodium methylsiliconate, methyltrimethoxysilane, potassium methylsiliconate, butyltrimethoxysilane, and vinyltrimethoxysilane.

Moreover, preferably, the anti-sand burning additive includes one or more selected from monosaccharides, polysaccharides, and disaccharides.

Furthermore, preferably, the original sand supplying step includes: a step of supplying the original sand measured to a predetermined amount from an original molding sand storage upper hopper to a sand measurement lower hopper; and a step of supplying the original sand from the sand measurement lower hopper to the muller.

Furthermore, preferably, the mulling step includes: a step of mulling the original molding sand supplied from the sand measurement lower hopper to the muller for 10 to 60 seconds; and a step of preparing mulled sand by being supplied with an inorganic binder from a binder supply device to the muller and mulling the inorganic binder for 30 to 120 seconds.

Moreover, preferably, in the sand supplying step, the mulled sand is supplied from the mulled sand hopper to the blowing head positioned under the mulled sand hopper, and the supplied mulled sand is distributed to an upper end of a blowing nozzle plate by a mulled sand flow guider positioned at a lower end within the blowing head.

Furthermore, preferably, the curing step includes: a step of preheating the core mold to 100 to 200° C.; and a step of curing and calcining the inside of the blown core.

According to a second aspect to achieve another object of the present disclosure, there is provided a core manufactured by using an inorganic binder according to the manufacturing method of a core.

Preferably, when the core is exposed in an environment condition with an absolute humidity of 20 to 30 g/m$^3$ for 3 hours, the core has a flexural strength of 60% or more with respect to an initial flexural strength.

More preferably, the initial flexural strength of the core is 150 N/cm$^2$ or more.

Furthermore, according to a third aspect to achieve yet another object of the present disclosure, there is provided, there is provided a manufacturing method of a casting product with a core using an inorganic binder, including:

a step of storing a core using an inorganic binder manufactured by the manufacturing method of a core;

a casting step of manufacturing a product by pouring molten metal of a predetermined material into a mold formed into a predetermined shape by using the stored core;

a mechanical sand removing step of removing the core used in the casting step; and a heating step including a water-quenching process of the sand-removed product, wherein in the water-quenching process of the heating step, a chemical sand removal is performed by adding a chemically hydrolyzed solution to hydrolyze the inorganic binder remaining in the core after the mechanical sand removing step.

Preferably, the chemically hydrolyzed solution is a silicate solution including sodium silicate or sodium metasilicate, or a phosphate solution including sodium phosphate or disodium phosphate.

Furthermore, according to a fourth aspect to achieve still another object of the present disclosure, there is provided a casting product manufactured according to the manufacturing method of a casting product with the core using an inorganic binder.

Furthermore, according to a fifth aspect to achieve still another object of the present disclosure, there is provided a manufacturing system of a core using an inorganic binder, including:

an upper hopper configured to store original molding sand;

a sand measurement lower hopper connected with a lower part of the upper hopper and configured to be supplied with the original molding sand from the upper hopper, measure the original molding sand to a predetermined amount, and supply the original molding sand to a muller;

an inorganic binder supply device configured to supply a stored inorganic binder in a predetermined amount to the muller;

a muller connected with the sand measurement lower hopper and the muller and configured to mix and mull the original molding sand supplied from the sand measurement lower hopper with an inorganic binder supplied from the inorganic binder supply device;

a mulled sand hopper configured to be supplied with mulled sand from the muller and supply the mulled sand to a blowing head;

the blowing head positioned under the mulled sand hopper and configured to be supplied with the mulled sand from the mulled sand hopper and blow the mulled sand into a core mold; and the core mold configured to cure and calcine the mulled sand blown from the blowing head, wherein the inorganic binder includes water glass of 40 to 70 parts by weight, nano-silica of 5 to 35 parts by weight, a Li-based water resistant additive of 0.1 to 10 parts by weight, an organic silicon compound of 0.1 to 10 parts by weight, and an anti-sand burning additive of 1 to 10 parts by weight.

Preferably, the blowing head includes a mulled sand flow guider at a lower end within the blowing head, and further includes a blowing nozzle plate including a blowing nozzle at a lower end of the mulled sand flow guider.

According to the manufacturing method of a core using an inorganic binder of the present disclosure, it is easy to perform a casting operation. Furthermore, it is easy to remove sand of a casting product manufactured by the casting operation and also, a sand burning phenomenon does not occur.

Furthermore, the casting product manufactured according to the manufacturing method of a core using an inorganic binder of the present disclosure has the excellent surface quality and formativeness and also exhibits the improved strength and filling ability.

Furthermore, according to the present disclosure, a curing process can be performed at a low temperature and a toxic substance is not generated, and, thus, a working environment is kept in a good condition. Furthermore, just a small amount of a gas is generated during a manufacturing process of a core and a casting process, and, thus, defects in casting are reduced, and there is no need to install an anti-environmental pollution system, and, thus, manufacturing costs can be reduced.

DETAILED DESCRIPTION OF THE PREFERRED EMBODIMENTS

Figure 1:
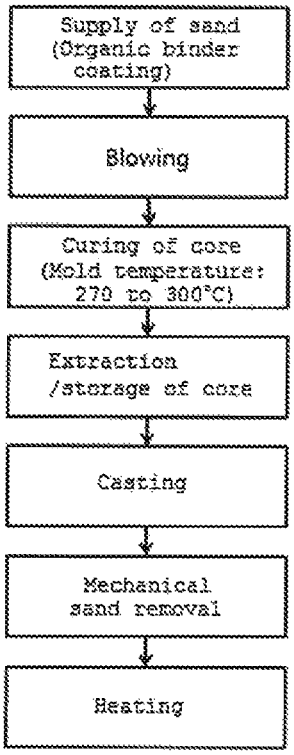
FIG. 1 is a flowchart illustrating a manufacturing process of a core and a casting product using an organic binder according to the prior art.

Hereinafter, preferred embodiments of the present disclosure will be described in more detail with reference to the accompanying drawings. In the drawings, the thicknesses of lines or the sizes of elements may be exaggerated for clarity and convenience of explanation.

Figure 2:
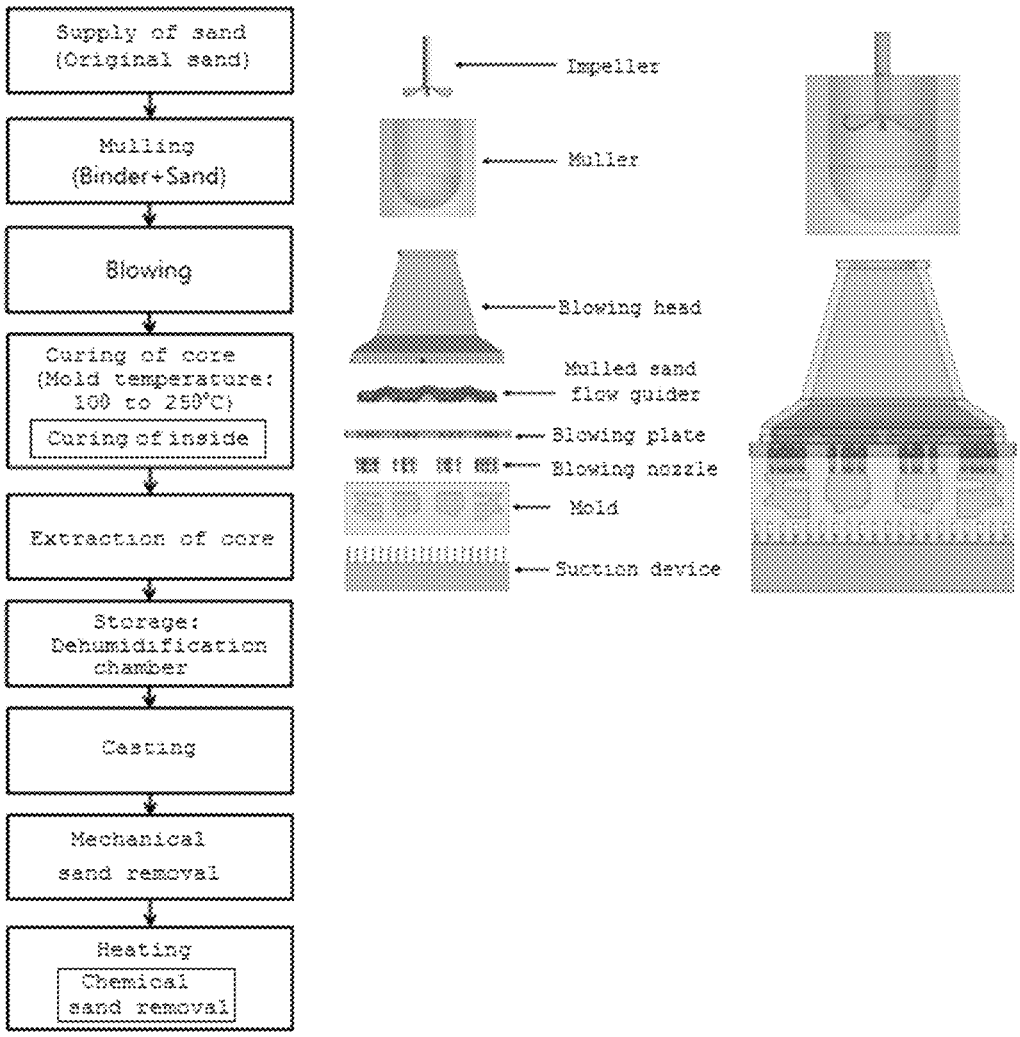
FIG. 2 is a mimetic diagram illustrating a manufacturing process of a core and a casting product using an inorganic binder according to the present disclosure.

FIG. 2 is a mimetic diagram illustrating a manufacturing process of a core and a casting product using an inorganic binder according to the present disclosure.

Referring to FIG. 2, in the present disclosure, an inorganic binder and original molding sand are mixed and a mold is used, so that a core is manufactured by using the inorganic binder, and the manufactured core undergoes a mechanical sand removal and a chemical sand removal while a casting product is manufactured, so that the core can be completely removed and the casting product can be manufactured.

To be specific, a manufacturing method of a core using an inorganic binder according to the present disclosure includes: an original sand supplying step in which original molding sand is supplied to a muller; a mulling step in which the original molding sand is mixed and mulled with a liquid inorganic binder including water glass and mulled sand is prepared by the muller; a sand transferring step in which the mulled sand is transferred from the muller to a mulled sand hopper; a sand supplying step in which the mulled sand is supplied from the mulled sand hopper to a blowing head positioned under the mulled sand hopper; a blowing step in which the mulled sand supplied into the blowing head is blown into a core mold; a gas exhausting step in which the inside of the core mold is exhausted and depressurized; a curing step in which after the core mold is preheated, the inside of the blown core is cured and calcined; and an extracting step in which the core mold is separated and the cured core is extracted, wherein the inorganic binder includes the water glass of 40 to 70 parts by weight, nano-silica of 5 to 35 parts by weight, a Li-based water resistant additive of 0.1 to 10 parts by weight, an organic silicon compound of 0.1 to 10 parts by weight, and an anti-sand burning additive of 1 to 10 parts by weight.

Figure 3:
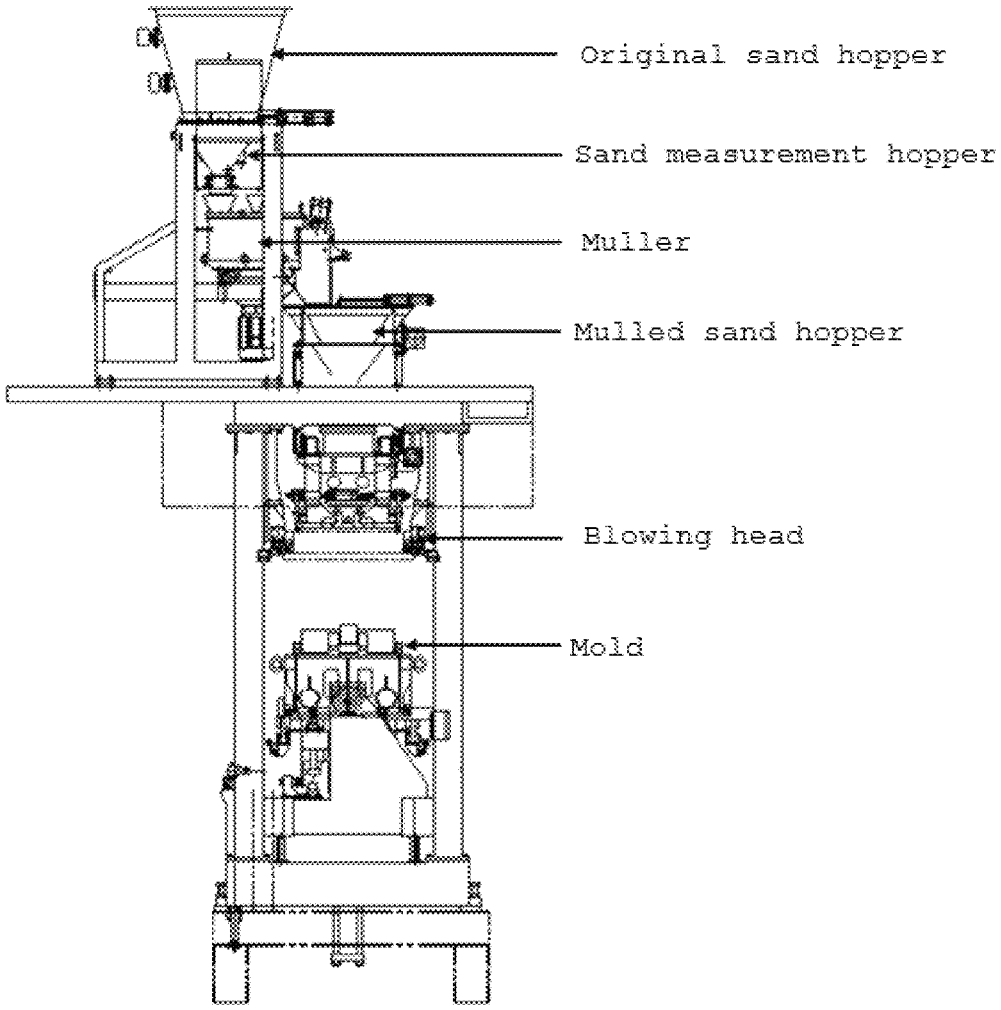
FIG. 3 is a diagram illustrating a configuration of a system for manufacturing a core using an inorganic binder according to an exemplary embodiment of the present disclosure.

FIG. 3 is a diagram illustrating a configuration of a system for manufacturing a core using an inorganic binder according to one embodiment of the present disclosure. Referring to FIG. 3, the step of the manufacturing method will be described in detail.

Firstly, the original sand supplying step is a step of supplying original molding sand to a muller. As illustrated in FIG. 3, an original molding sand storage upper hopper is provided at an uppermost end of the system, and the original sand is measured to a predetermined amount and supplied from the upper hopper to a sand measurement lower hopper and then supplied from the sand measurement lower hopper to the muller.

Herein, a filter configured to filter a foreign substance which may be mulled in the original sand may be provided at an uppermost surface of the upper hopper. Preferably, a filter having a mesh size of AFS 20 or more may be provided.

Furthermore, the upper hopper includes an upper level sensor for suppressing overflow of the original molding sand therein and a lower level sensor for detecting lack of the original molding sand at a lower part thereof.

Furthermore, the sand measurement lower hopper includes a sand measurement button for supplying the original sand in a predetermined amount to the muller, and is programmed to select a desired amount of the original sand. Therefore, if the sand measurement button is pushed and operated, 20 to 70 kg of the original sand is supplied through a measurement pipe within the sand measurement lower hopper within about 20 to 60 seconds depending on the amount of the supplied original sand. A gate for supplying the original sand to the muller after the original sand is supplied is provided at the lower part. A lower gate ON/OFF button is provided, so that the original sand is supplied to the muller by regulating opening/closing of the lower gate.

Then, the mulling step is a step of preparing mulled sand by mulling the original molding sand with a liquid inorganic binder including water glass by the muller.

To be specific, the muller includes a muller and an inorganic binder supply device configured to supply an inorganic binder to the muller. The muller includes an inorganic binder supply ON/OFF button, a mulling container configured to accommodate and mull original sand and an inorganic binder therein, an impeller configured to equally mull the inorganic binder with the original sand, a motor configured to rotate the impeller, an ON/OFF button configured to control the motor to be driven or stopped, and a volume gauge configured to adjust a RPM of the muller.

Furthermore, a constant delivery motor for constant supply is provided in the inorganic binder supply device, and a pipe circulation system may be installed in order to prevent the inorganic binder within the pipe from being set and thus solidified. Furthermore, the inorganic binder supply device includes a RPM control dial and is programmed so as to adjust a mulling time and a speed depending on the amounts and the properties of the original sand and the inorganic binder.

Also, a gate configured to supply the original sand and the inorganic binder is provided on the muller, and an openable and closable lid is provided in order to clean and check the inside of the muller. A mulled sand transfer gate configured to supply the prepared mulled sand to the mulled sand hopper is provided at a side surface of the muller, and includes a sand transfer ON/OFF button.

Herein, a transfer path is formed under the sand transfer gate in order for the mulled sand not to be exposed or discharged to the outside when the prepared mulled sand is supplied to the mulled sand hopper. In the following description, this will be referred to as "sand transfer chute". A vibrator (oscillator) is provided under the sand transfer chute in order for the mulled sand to be supplied without stagnation while the sand is distributed. The vibrator is operated only while the sand transfer ON button is pushed, and programmed so as to set a vibration time when an operation is continuously (automatically) performed.

In the mulling step using the muller, first, the muller is rotated at 60 to 150 RPM, and during mulling, a sand measurement lower hopper gate is opened and then, the original sand is supplied to the muller at the same time when the impeller is rotated. Preferably, primary mulling is performed to equally spread the original sand for 10 to 60 seconds. Then, after the primary mulling, while the impeller is continuously rotated, the inorganic binder supply ON button is pushed to supply the liquid inorganic binder in an amount of 1 to 6 weight % with respect to the sand from the inorganic binder supply device, so that secondary mulling is performed to equally mull the liquid inorganic binder with the original sand for 30 to 120 seconds depending on the amount of the binder.

Herein, the inorganic binder includes water glass of 40 to 70 parts by weight, nano-silica of 5 to 35 parts by weight, a Li-based water resistant additive of 0.1 to 10 parts by weight, an organic silicon compound of 0.1 to 10 parts by weight, and an anti-sand burning additive of 1 to 10 parts by weight. The inorganic binder includes the nano-silica, the Li-based water resistant additive, the organic silicon compound, and the anti-sand burning additive in the water glass, and, thus, the strength and water resistance of the core are supplemented so as to be suitable for a climate of high temperature and high humidity and there are improvements in fluidity, sand removal, and sand burning.

To be specific, the nano-silica is a silicon dioxide ($SiO_2$) particle having a structure of 5 to 20 nanometers in size, and micro pores are formed to be parallel to a particle surface or the pores have irregular directions. Thus, it is difficult for a foreign substance to enter the inside of the pores. Furthermore, when the nano-silica is synthesized with the water glass, the strength can be improved by increasing the amount of Si, and the water resistance and water repellency of a binder composition can be improved due to a structure of the nano-silica particle. Herein, if the nano-silica is included in an amount of more than 35 parts by weight, the fluidity of the inorganic binder is decreased and the excess of silica particles inhibits a curing process. Therefore, preferably, the nano-silica may be included in an amount of 5 to 35 parts by weight.

In one embodiment, the Li-based water resistant additive includes one or more selected from lithium carbonate, lithium silicate, lithium hydroxide, lithium sulfate, lithium bromide, and lithium acetate. The Li-based water resistant additive is stable at room temperature and has a low viscosity even when $SiO_2$ has a concentration as high as the water glass and a molar ratio is close to 8. Furthermore, the Li-based water resistant additive has a mixed alkali effect with Na ions in the water glass, and, thus, the chemical durability of the finished inorganic binder can be increased and the water resistance can be improved. Herein, if the Li-based water resistant additive is included in an amount of more than 10 parts by weight, a network structure of the inorganic binder is broken, resulting in a decreased in the chemical durability and the water resistance. Therefore, preferably, the Li-based water resistant additive may be included in an amount of 0.1 to 10 parts by weight in the inorganic binder of the present disclosure.

In one embodiment, the organic silicon compound includes an organic functional group chemically bonded to an organic material and a hydrolysis group which can react with an inorganic material in the same molecule, so that the organic silicon compound can combine the organic material with the inorganic material. Thus, the mechanical strength and the water resistance of the inorganic binder of the present disclosure can be increased and the quality thereof can be improved, so that the organic silicon compound endows a hydrophobic property. Preferably, the organic silicon compound may include one or more selected from tetraethoxysilane, methyltriethoxysilane, sodium methylsiliconate, methyltrimethoxysilane, potassium methylsiliconate, butyltrimethoxysilane, and vinyltrimethoxysilane. More preferably, the organic silicon compound may be included in an amount of 0.1 to 10 parts by weight in the inorganic binder. This is because if the organic silicon compound is included in an amount of more than 10 parts by weight, the price of the inorganic binder may be increased and the property of the finally finished inorganic binder composition may deteriorate.

In one embodiment, the anti-sand burning additive includes one or more selected from monosaccharides, polysaccharides, and disaccharides. Preferably, the monosaccharides may include one or more selected from dextrose, fructose, mannose, galactose, glucose, and ribose; the polysaccharides may include one or more selected from starch, glycogen, cellulose, chitin, and pectin; and the disaccharides may include one or more selected from maltose, sugar, lactose, maltose, and lactose.

Furthermore, since the inorganic binder includes the nano-silica, the Li-based water resistant additive, the organic silicon compound, and saccharides as additives in the water glass, the inorganic binder increases a binding force in the binder composition, resulting in an improvement in the strength of the binder and the water resistance and the water repellency of the binder composition together with an increase in a binding force with water. Thus, the inorganic binder can be completely dissolved in an aqueous solution, so that a binding force with sand is improved when the inorganic binder is mixed with the original molding sand, it is possible to manufacture a core which is excellent in strength and water resistance and in which sand burning is prevented.

Furthermore, after the secondary mulling, the secondary mulling process of adding an additive suitable for a property of the core may be repeatedly performed. In this case, a supply device for supplying the additive may be additionally provided.

Herein, an inorganic additive or a curing agent may be supplied as the additive so as to further improve the strength, flexibility, and hardness of the core. In this case, preferably, the curing agent may include one or more selected from sodium hydroxide, sodium carbonate, potassium hydroxide, potassium carbonate, sodium phosphate, disodium phosphate, trisodium phosphate, and sodium sulfate. Furthermore, the amount of the added curing agent is excessive, a hydrophilic property of the inorganic binder is increased, resulting in a decrease in the water resistance of the inorganic binder. Thus, more preferably, the curing agent may be included in an amount of 0.1 to 5.0 parts by weight with respect to the total weight of the inorganic binder composition.

Then, the sand transferring step is a step of transferring the mulled sand prepared in the mulling step to the mulled sand hopper. This step may take about 30 to 60 seconds depending on the amount of the mulled sand.

Herein, the mulled sand hopper may include a mulled sand storage box configured to store a predetermined amount of mulled sand, a level sensor configured to detect lack of mulled sand within the mulled sand hopper and give an instruction to resupply mulled sand, a mulled sand hopper gate positioned on the mulled sand hopper and configured to be opened and closed when mulled sand is supplied, a vibrator positioned at a side surface of the mulled sand hopper and configured to facilitate a supply of mulled sand and suppress stagnation of the mulled sand when the mulled sand is supplied from the mulled sand hopper to the blowing head, and a sand gate positioned under the mulled sand hopper and configured to resupply the supplied mulled sand to the blowing head.

To be specific, before the mulled sand is transferred from the muller, a button for opening the mulled sand hopper gate is pushed to open the mulled sand hopper gate, and when a sand transfer button of the muller is pushed, a sand transfer gate in the muller is opened and the vibrator in the muller and the vibrator in the mulled sand hopper vibrate at the same time, so that the mulled sand is supplied through the sand transfer chute. After the mulled sand is supplied to the mulled sand hopper, the sand transfer gate is closed and then, the mulled sand hopper gate is closed. After the supply is ended, the vibrators stop vibration.

Then, the sand supplying step is a step of supplying the mulled sand supplied to the mulled sand hopper in the sand transferring step to the blowing head.

In this case, the blowing head is a system configured to blow the mulled sand into a mold by using an appropriate pressure. When the mulled sand is supplied to the blowing head, the sand gate positioned under the mulled sand hopper and a mulled sand gate positioned at an upper end of the blowing head are opened and the vibrator in the mulled sand hopper vibrates, so that the mulled sand is supplied to the blowing head. After an appropriate amount of the mulled sand is supplied, the blowing head is closed by a limit sensor provided on the blowing head.

Furthermore, the blowing head includes a mulled sand flow guider at a lower end within the blowing head, and further includes a blowing nozzle plate including a blowing nozzle at a lower end of the mulled sand flow guider.

Therefore, in the sand supplying step, the mulled sand is supplied from the mulled sand hopper to the blowing head positioned under the mulled sand hopper and the supplied mulled sand is distributed to an upper end of the blowing nozzle plate by the mulled sand flow guider positioned at the lower end within the blowing head. This step may take about 2 to 10 seconds depending on the amount of the mulled sand.

Then, the blowing step is a step of blowing the mulled sand supplied into the blowing head to the inside of the core mold having a desired shape.

Herein, the blowing head may have a structure in which coolant is circulated in order to maintain a predetermined temperature. In this case, the major components may include a coolant nozzle for injecting the coolant, a mulled sand gate configured to be opened and closed when the mulled sand is supplied, a sensor configured to detect excess or lack of the mulled sand when the mulled sand is supplied, a blowing nozzle positioned at a specific space and configured to blow the mulled sand into a mold at a predetermined pressure, a nozzle rubber configured to suppress damage to an end of the nozzle during blowing, and a regulator provided to regulate a blowing pressure depending on the property of the mulled sand during blowing, and the blowing head is programmed so as to adjust a blowing time in order to adjust a suction rate.

Furthermore, in the blowing step, the blowing head is positioned under the mulled sand hopper so as to supply the mulled sand. After a supply of the mulled sand is ended, the blowing head is moved to the core mold. The blowing head moved above the core mold is lowered down and a nozzle is inserted from an appropriate height into a blowing hole on the mold and blows the mulled sand into the mold at a predetermined pressure.

Then, the gas exhausting step is a step of reducing an internal pressure after the mulled sand is blown into the mold at a predetermined pressure. Herein, a silencer for eliminating noise caused by a high pressure while the gas is exhausted may be provided, and is programmed so as to adjust a gas exhausting time.

Then, the curing step is a step of curing and calcining the inside of the blown core after the core mold is preheated. To be specific, the step includes a step of preheating the core mold to 100 to 200° C. and a step of curing and calcining the inside of the blown core.

Therefore, a heating system may be provided in the mold so as to preheat the mold to an appropriate temperature, and a temperature sensor may be provided in each mold so as to maintain a predetermined temperature. The heating system is programmed so as to select a calcining time.

Then, the extracting step is a step of extracting a finished product produced into a core by curing the blown mulled sand at the time of ending the curing step. To be specific, the mold which may include an upper mold and a lower mold or a left mold and a right mold is separated, and an extraction pin provided at a lower part of the mold may move the core to a position easy to be extracted and then, the produced core may be extracted by a machine or a hand.

The extracted core is manufactured by using an inorganic binder and thus improved in water resistance and strength.

Therefore, the core of the present disclosure manufactured by using an inorganic binder according to the above-described method can satisfy water resistance and strength even at a high temperature and a high humidity in summer. Therefore, when the core is exposed in an environment condition with an absolute humidity of 20 to 30 g/m$^3$ for 3 hours, the core has a flexural strength of 60% or more with respect to an initial flexural strength. According to an exemplary embodiment of the present disclosure, after an exposure at a temperature of 30 to 40° C. and a relative humidity of 60 to 70% (absolute humidity of 20 to 30 g/m$^3$) for 3 hours, strength is 60% or more with respect to an initial strength. In particular, the core of the present disclosure has an initial strength of 150 N/cm$^2$ or more, and even after an exposure in the environment condition with an absolute humidity of 20 to 30 g/m$^3$ for 3 hours, the core maintains a flexural strength at 150 N/cm$^2$ or more.

As such, according to one embodiment, a core is manufactured by using an eco-friendly inorganic binder and a casting product is manufactured by using the core. To be specific, the manufacturing method of a casting product with a core using an inorganic binder of the present disclosure includes: a step of storing a core using an inorganic binder manufactured by the manufacturing method of a core; a casting step of manufacturing a product by pouring molten metal of a predetermined material into a mold formed into a predetermined shape by using the stored core; a mechanical sand removing step of removing the core used in the casting step; and a heating step including a water-quenching process of the sand-removed product, wherein in the water-quenching process of the heating step, a chemical sand removal is performed by adding a chemically hydrolyzed solution to hydrolyze the inorganic binder remaining in the core after the mechanical sand removing step.

To be specific, the storing step is a step of maintaining a core manufactured by the above-described method and completely extracted at a predetermined temperature/humidity and storing the core in a sealed space. Preferably, the temperature is 10 to 30° C. and the humidity is 10 to 50%.

Then, the casting step is a step of manufacturing a product by pouring molten metal (referring to a source material molten into a liquid state) of a predetermined material into a mold formed into a predetermined shape by using the stored core.

Then, the mechanical sand removing step is a step of removing the core used for casting the product by applying a predetermined pressure or vibration to the core within the product and rotating the core.

Then, the heating step is a step of heating the sand-removed product for supplementing mechanical and physical properties of the sand-removed product. In particular, the heating step includes a water-quenching process. In the water-quenching process, a chemical sand removal is performed by adding a chemically hydrolyzed solution of the inorganic binder into water so as to chemically hydrolyze and completely decompose the inorganic binder remaining in the core after the mechanical sand removing step, thereby accelerating sand removal. That is, in the water-quenching process, a chemical sand removal is performed by charging the cured sand remaining in the casting product after the mechanical sand removing step in a water tank added with a chemically hydrolyzed solution.

Herein, the chemically hydrolyzed solution may be a silicate solution including sodium silicate or sodium metasilicate, or a phosphate solution including sodium phosphate or disodium phosphate, and may have a concentration of preferably 1 to 30 mol %.

As such, the casting product manufactured with a core using an inorganic binder has the excellent surface quality and formativeness and also exhibits the improved strength and filling ability.

Furthermore, according to one embodiment, a core can be manufactured by using an eco-friendly inorganic binder. The manufacturing system of a core using an inorganic binder, including: an upper hopper configured to store original molding sand; a sand measurement lower hopper connected with a lower part of the upper hopper and configured to be supplied with the original molding sand from the upper hopper, measure the original molding sand to a predetermined amount, and supply the original molding sand to a muller; an inorganic binder supply device configured to supply a stored inorganic binder in a predetermined amount to the muller; a muller connected with the sand measurement lower hopper and the muller and configured to mixed and mull the original molding sand supplied from the sand measurement lower hopper with an inorganic binder supplied from the inorganic binder supply device; a mulled sand hopper configured to be supplied with mulled sand from the muller and supply the mulled sand to a blowing head; the blowing head positioned under the mulled sand hopper and configured to be supplied with the mulled sand from the mulled sand hopper and blow the mulled sand into a core mold; and the core mold configured to cure and calcine the mulled sand blown from the blowing head. Herein, the blowing head may include a mulled sand flow guider at a lower end within the blowing head, and may further include a blowing nozzle plate including a blowing nozzle at a lower end of the mulled sand flow guider.

Hereinafter, the present disclosure will be described in detail with reference to Examples, but a scope of the present disclosure is not limited thereto.

EXAMPLE 1

Preparation of Inorganic Binder

An inorganic binder was prepared by adding each of a Li-based water resistant additive, nano-silica, and an organic silicon compound into water glass and synthesizing them. A hygroscopic property of the inorganic binder was evaluated by using a binder residual rate. The following Table 1 lists the compositions of inorganic binders and an evaluation result of hygroscopic property.

TABLE 1

| | Sample 1 | Sample 2 | Sample 3 | Sample 4 |
|---|---|---|---|---|
| Water glass | 95 | 90 | 85 | 80 |
| Li-based water resistant additive | 5 | 10 | 15 | 20 |
| Binder residual rate (%) | 8.23 | 91.16 | 98.83 | 98.47 |
| Viscosity (cps) | 32 | 42 | 456 | 1460 |
| | **Sample 5** | **Sample 6** | **Sample 7** | **Sample 8** |
| Water glass | 90 | 80 | 70 | 60 |
| Nano-silica | 10 | 20 | 30 | 40 |
| Binder residual rate (%) | 3.63 | 8.23 | 98.27 | 99.64 |
| Viscosity (cps) | 22 | 42 | 234 | 1840 |
| | **Sample 9** | **Sample 10** | **Sample 11** | **Sample 12** |
| Water glass | 95 | 90 | 85 | 80 |
| Organic silicon compound | 5 | 10 | 15 | 20 |
| Binder residual rate (%) | 8.23 | 4.56 | 10.7 | 10.76 |
| Viscosity (cps) | 62 | 42 | 32 | 16 |

Referring to Table 1, it can be seen that in the samples 1 to 4, as the amount of the Li-based water resistant additive increases, the binder residual rate and the viscosity increase. Therefore, it can be seen that the amount of the Li-based water resistant additive increases, the water resistance and the viscosity increases.

Furthermore, it can be seen that in the samples 5 to 8, as the amount of the nano-silica increases, the amount of silicon constituting the inorganic binder increases, and, thus, the binder residual rate and the viscosity increase. This means that as the amount of the nano-silica increases, the water resistance is improved and the viscosity is increased.

Furthermore, it can be seen that in the samples 9 to 12, when a change in the binder residual rate according to a change in the amount of the organic silicon compound is small, the organic silicon compound does not greatly contribute to an improvement in the water resistance of the inorganic binder, but as the amount of the organic silicon compound increases, the viscosity decreases.

EXAMPLE 2

Manufacturing of Core Using Inorganic Binder

The inorganic binder samples 1 to 12 prepared in Example 1 were prepared by adding all of a Li-based water resistant additive, nano-silica, and an organic silicon compound as listed in the following Table 2, and a disaccharide, a monosaccharide, and a polysaccharide of 1 to 10% were further added and mixed as an anti-sand burning additive, so that the inorganic binders including all of the Li-based water resistant additive, the nano-silica, the organic silicon compound, and the anti-sand burning additive were prepared. The cores were manufactured by using the prepared inorganic binders.

The compositions of the prepared inorganic binders were as listed in Table 2.

TABLE 2

| Core Name | Core 1 | Core 2 | Core 3 | Core 4 |
|---|---|---|---|---|
| Composition | Sample 1 + Sample 5 + Sample 9 + Anti-sand burning additive | Sample 1 + Sample 6 + Sample 9 + Anti-sand burning additive | Sample 2 + Sample 6 + Sample 10 + Anti-sand burning additive | Sample 1 + Sample 6 + Sample 10 + Anti-sand burning additive |

Herein, a manufacturing process of a core was as follows.

Firstly, Vietnam sand AFS 55 and a liquid inorganic binder of 1 to 6% with respect to the dried sand AFS 55 were mixed in a mixer and mulled for 100 to 160 seconds, so that mulled sand was prepared.

Then, the mulled sand was injected into a mold heated to 130 to 150° C. at a pressure of 1 to 10 bars and then cured, so that a core was manufactured.

Then, the manufactured core was extracted and cooled at room temperature.

The manufacturing process of a core, the manufacturing system of a core, and the manufacturing condition according to Example 2 were as illustrated in FIG. 2, FIG. 3, and listed in the following Table 3.

TABLE 3

| Classification | Molding Condition |
|---|---|
| Sand | AFS 36 to 75 |
| Amount of binder | 1 to 6 weight % |
| Mulling time | 100 to 160 sec |
| Blowing pressure | 1 to 10 bar |
| Temperature of mold | 100 to 200° C. |
| Calcining time | 60 to 100 sec |
| Blowing time | 1 to 5 sec |
| Gas exhausting time | 1 to 5 sec |
| Temperature of coolant | Room temperature ± 5° C. |

EXAMPLE 3

Manufacturing of Casting Product

Figure 9:
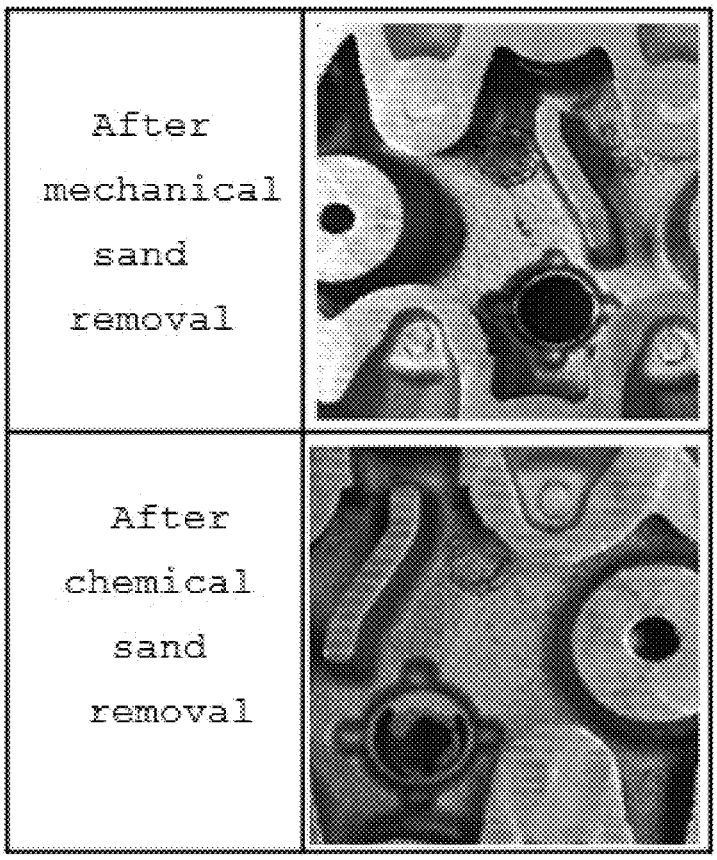
FIG. 9 illustrates an evaluation result of sand removal and sand burning of a core using an inorganic binder and manufactured according to one embodiment of the present disclosure.

In Example 3, the core extracted and cooled in Example 2 was stored in a dehumidification chamber (temperature: 10 to 30° C., humidity: 10 to 50%) and then, molten metal of aluminum was poured into a mold having a predetermined shape by using the core, so that a product was casted. Then, a mechanic sand removal was performed in order to remove the core within the product. Then, a heating process is performed in order to supplement mechanical and physical properties of the casted product, and during a water-quenching process in the heating process, a sodium silicate solution was added into water so as to remove sand by chemical hydrolysis. Then, the binder remaining in the core was completely decomposed to remove a binding force. As a result, it was confirmed that the binder was completely removed as illustrated in FIG. 9.

EXAMPLE 4

Property Evaluation 1 of Core

A flexural strength of a core depending on the composition of the inorganic binder prepared in Example 2 was evaluated. As Comparative Example, cores manufactured by using a Company A-1 inorganic binder and a Company A-2 inorganic binder conventionally used were also evaluated.

To be specific, after an inorganic binder core specimen was produced, the inorganic binder core was on standby at room temperature for 1 hour without inputting a thermohygrostat. Then, an evaluation of flexural strength was conducted. The results thereof were as illustrated in FIG. 4.

Figure 4:
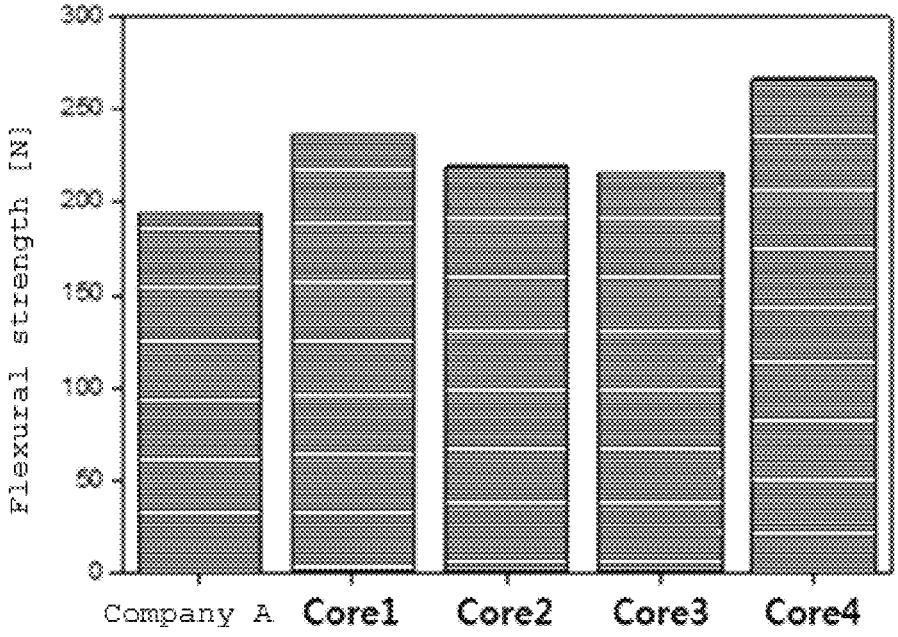
FIG. 4 illustrates an evaluation result of strength and a formativeness of a core using an inorganic binder and manufactured according to one embodiment of the present disclosure.

Referring to FIG. 4, the inorganic binder manufactured by adding the additives according to the present disclosure has a higher flexural strength than the conventionally used inorganic binder (Company A-1 binder). It is deemed that this is because the inorganic binder used in the present disclosure improves the strength of the core by mutual complement in each composition of additives.

Figure 5:
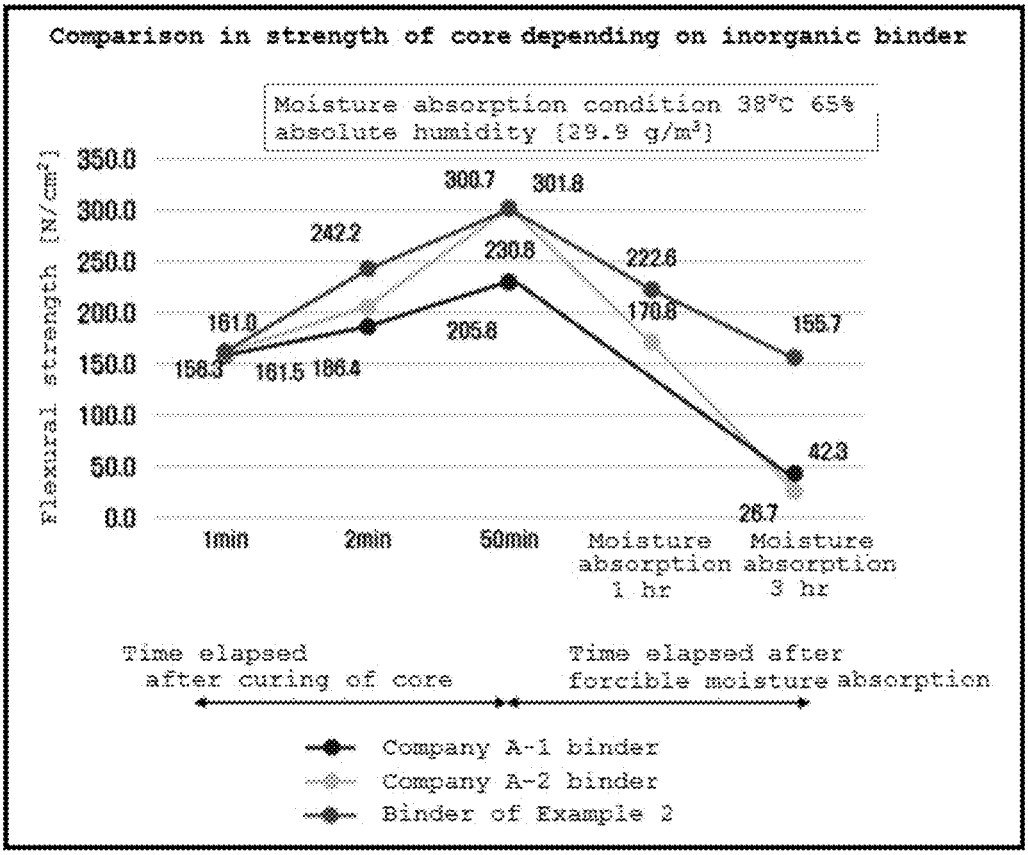
FIG. 5 illustrates a flexural strength over time after a core using an inorganic binder and manufactured according to one embodiment of the present disclosure is cured and a flexural strength over time after moisture is forcibly absorbed.

Furthermore, FIG. 5 exhibits the overall result of an evaluation of flexural strength conducted at each time point of 1 min, 2 min, and 50 min after an inorganic binder core specimen was produced by using the inorganic binder used for manufacturing Core 4 and cooled at room temperature without inputting a thermohygrostat, and a measurement of flexural strength after an exposure at each time point of moisture absorption 1 hr and moisture absorption 3hr at a temperature of 38° C. and a humidity of 65% in the thermohygrostat and at an absolute humidity of about 30 $g/m^3$.

Referring to FIG. 5, the initial strength of the inorganic binder core was somewhat similar at the time point of 1 min, but an increase in strength at the time point of 2 min was high, as compared with the other inorganic binders. The maximum strength was equivalent to the conventionally used inorganic binder (Company A-2 binder).

However, according to the result of the strength evaluation after moisture absorption, it was confirmed that the conventionally used inorganic binder was remarkably decreased in moisture absorption intensity, whereas the inorganic binder of the present disclosure had the highest moisture absorption intensity and maintained the initial intensity even after 3 hours. Furthermore, it can be seen that a decrement of the moisture absorption intensity exhibits a gentle slope, and, thus, it can be seen that the inorganic binder of the present disclosure has the highest resistance to moisture absorption. Therefore, it is deemed that the inorganic binder of the present disclosure may be the easiest to use considering Korean weather conditions including summer (rainy season).

EXAMPLE 5

Property Evaluation 2 of Core

A property evaluation was conducted to the cores manufactured in Example 2 in terms of core molding and casting. The results thereof were as illustrated in FIG. 6 to FIG. 9 and listed in the following Table 4.

Figure 6:
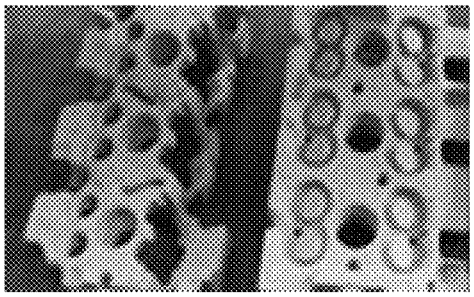
FIG. 6 illustrates a shape and a surface quality of a core using an inorganic binder and manufactured according to one embodiment of the present disclosure.

FIG. 6 shows an evaluation result of formativeness. Referring to FIG. 6, it can be seen that the formativeness is good and there is no big difference in surface quality from the case of using the conventionally used inorganic binder.

Figure 7:
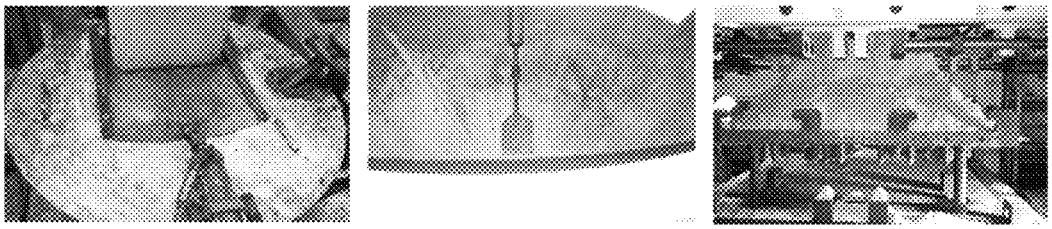
FIG. 7 shows an evaluation result of fluidity of a core using an inorganic binder and manufactured according to one embodiment of the present disclosure.

FIG. 7 shows an evaluation result of fluidity. Referring to FIG. 7, it can be seen that when mulled sand is filled from the mulled sand hopper into the blowing head, the sand is transferred therein without clogging, and it can also be seen that when an angle of repose of the mulled sand filled in the blowing head is checked, the mulled sand is uniformly distributed in a triangular shape. This means that the mulled sand is filled up to an end of a nozzle and there is no problem with fluidity.

Furthermore, according to an evaluation result of casting, an initial handling strength was good at the time of casting, and a surface drop and core print damage was not observed after casting. Furthermore, it can be seen that there was no defect in external appearance.

Figure 8:
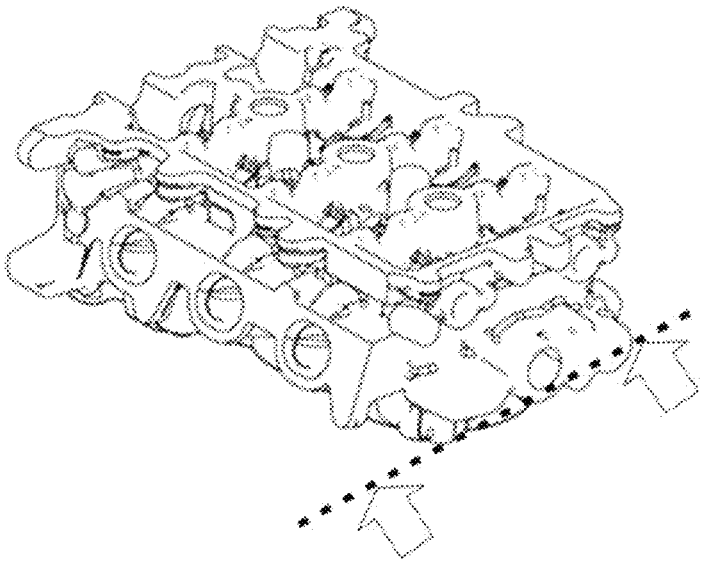
FIG. 8 is a diagram illustrating an external appearance of a final product produced by using a core using an inorganic binder and manufactured according to one embodiment of the present disclosure.

FIG. 8 is a diagram illustrating an external appearance of a final product produced by casting with a core manufactured according to Examples. According to an evaluation result of sand removal and sand burning, no mulled sand was observed in the casting product after sand removal and sand burning did not occur.

FIG. 9 illustrates that a part of an internal appearance when a casting product is cut as indicated in FIG. 8 if the casting product having a shape as illustrated in FIG. 8 is obtained by casting with a core manufactured according to Example as shown in FIG. 6. It was confirmed that sand burning did not occur in both of mechanic sand removal and chemical sand removal. This means that a sand burning phenomenon is improved due to the properties of the inorganic binder.

TABLE 4

| Classification | | Comparative Evaluation | |
|---|---|---|---|
| | | Use of Inorganic Binder of Example 2 | Use of Company A-1 Binder |
| Core molding | Fluidity | ○ | ○ |
| | Filling ability | ○ | Δ |
| | Strength | ○ | Δ |
| | Water resistance | ○ | Δ |
| | Surface quality | ○ | ○ |
| | Nozzle clogging | ○ | X |
| Casting | Castability | ○ | ○ |
| | Sand removability (Sand burning) | ○ | Δ |
| | Roughness | ○ | ○ |
| | Product defect | ○ | Δ |
| | Generation of harmful gas | ○ | ○ |

(○: Good, Δ: Normal, X: Bad)

Furthermore, referring to Table 4, when a core is manufactured according to Example 3, the core is excellent in terms of core molding properties such as fluidity, filling ability, strength, and water resistance and in terms of casting properties such as castability and sand removability (sand burning). Therefore, it can be seen that it is possible to manufacture the core having a high usability in casting operation with an excellent quality.

According to the manufacturing method of a core using an inorganic binder of the present disclosure, it is easy to perform a casting operation. Furthermore, it is easy to remove sand of a casting product manufactured by the casting operation and also, a sand burning phenomenon does not occur.

Furthermore, the casting product manufactured according to the manufacturing method of a core using an inorganic binder of the present disclosure has the excellent surface quality and formativeness and also exhibits the improved strength and filling ability.

Furthermore, according to the present disclosure, a curing process can be performed at a low temperature and a toxic substance is not generated, and, thus, a working environment is kept in a good condition. Furthermore, just a small amount of a gas is generated during a manufacturing process of a core and a casting process, and, thus, defects in casting are reduced, and there is no need to install an anti-environmental pollution system, and, thus, manufacturing costs can be reduced.

While the present disclosure has been described with respect to the specific embodiments, it will be apparent to those skilled in the art that various changes and modifications may be made without departing from the spirit and scope of the invention as defined in the following claims.

What is claimed is:

1. A manufacturing method of a core using an inorganic binder, comprising:

an original sand supplying step in which original molding sand is supplied to a muller;

a mulling step in which the original molding sand is mixed and mulled with a liquid inorganic binder including water glass and mulled sand is prepared by the muller;

a sand transferring step in which the mulled sand is transferred from the muller to a mulled sand hopper;

a sand supplying step in which the mulled sand is supplied from the mulled sand hopper to a blowing head positioned under the mulled sand hopper;

a blowing step in which the mulled sand supplied into the blowing head is blown into a core mold;

a gas exhausting step in which the inside of the core mold is exhausted and depressurized;

a curing step in which after the core mold is preheated, the inside of the blown core is cured and calcined; and an extracting step in which the core mold is separated and the cured core is extracted, wherein the inorganic binder includes the water glass of 40 to 70 parts by weight, nano-silica of 5 to 35 parts by weight, a Li-based water resistant additive of 0.1 to 10 parts by weight, an organic silicon compound of 0.1 to 10 parts by weight, and an anti-sand burning additive of 1 to 10 parts by weight.

2. The manufacturing method of a core using an inorganic binder according to claim 1, wherein the inorganic binder is mixed in an amount of 1 to 6 weight % with respect to the original molding sand.

3. The manufacturing method of a core using an inorganic binder according to claim 1, wherein the Li-based water resistant additive includes one or more selected from lithium carbonate, lithium silicate, lithium hydroxide, lithium sulfate, lithium bromide, and lithium acetate.

4. The manufacturing method of a core using an inorganic binder according to claim 1, wherein the organic silicon compound includes one or more selected from methyltriethoxysilane, sodium methylsiliconate, methyltrimethoxysilane, potassium methylsiliconate, butyltrimethoxysilane, and vinyltrimethoxysilane.

5. The manufacturing method of a core using an inorganic binder according to claim 1, wherein the anti-sand burning additive includes one or more selected from monosaccharides, polysaccharides, and disaccharides.

6. The manufacturing method of a core using an inorganic binder according to claim 1, wherein the original sand supplying step includes:

a step of supplying the original sand measured to a predetermined amount from an original molding sand storage upper hopper to a sand measurement lower hopper; and a step of supplying the original sand from the sand measurement lower hopper to the muller.

7. The manufacturing method of a core using an inorganic binder according to claim 6, wherein the mulling step includes:

a step of mulling the original molding sand supplied from the sand measurement lower hopper to the muller for 10 to 60 seconds; and a step of preparing mulled sand by being supplied with an inorganic binder from a binder supply device to the muller and mulling the inorganic binder for 30 to 120 seconds.

8. The manufacturing method of a core using an inorganic binder according to claim 1, wherein in the sand supplying step, the mulled sand is supplied from the mulled sand hopper to the blowing head positioned under the mulled sand hopper, and the supplied mulled sand is distributed to an upper end of a blowing nozzle plate by a mulled sand flow guider positioned at a lower end within the blowing head.

9. A core manufactured by using an inorganic binder by the manufacturing method of a core using an inorganic binder according to claim 1.

10. The core manufactured by using an inorganic binder according to claim 9, wherein when the core is exposed in an environment condition with an absolute humidity of 20 to 30 $g/m^3$ for 3 hours, the core has a flexural strength of 60% or more with respect to an initial flexural strength.

11. The core manufactured by using an inorganic binder according to claim 10, wherein the initial flexural strength of the core is 150 $N/cm^2$ or more.

12. A manufacturing method of a casting product with a core using an inorganic binder, comprising:

a step of storing a core using an inorganic binder manufactured by the manufacturing method of a core according claim 1;

a casting step of manufacturing a product by pouring molten metal of a predetermined material into a mold formed into a predetermined shape by using the stored core;

a mechanical sand removing step of removing the core used in the casting step; and a heating step including a water-quenching process of the sand-removed product, wherein in the water-quenching process of the heating step, a chemical sand removal is performed by adding a chemically hydrolyzed solution to hydrolyze the inorganic binder remaining in the core after the mechanical sand removing step.

13. The manufacturing method of a casting product with a core using an inorganic binder according to claim 12, wherein the chemically hydrolyzed solution is a silicate solution including sodium silicate or sodium metasilicate, or a phosphate solution including sodium phosphate or disodium phosphate.

* * * * *